United States Patent [19]

Roberts

[11] Patent Number: 4,641,606

[45] Date of Patent: Feb. 10, 1987

[54] CELL BOILER

[75] Inventor: Alfred L. Roberts, West Monroe, La.

[73] Assignee: Delta Salvage Energy, Inc., Monroe, La.

[21] Appl. No.: 833,122

[22] Filed: Feb. 26, 1986

[51] Int. Cl.[4] ..... F22B 25/00

[52] U.S. Cl. ..... 122/214; 110/234; 122/1 C; 122/110; 122/138; 122/393; 122/421; 122/444; 122/461; 122/470

[58] Field of Search ..... 110/234; 122/1 R, 1 C, 122/2, 6 A, 7 R, 51, 52, 110, 136 R, 137–138, 140 R, 140 A, 145, 214–215, 217, 211, 332, 420–421, 426, 444, 461, 469–470, 415, 149, 151, 158, 393

[56] References Cited

U.S. PATENT DOCUMENTS

| | | | |
|---|---|---|---|
| 1,470,744 | 10/1923 | Jacobus | 122/444 X |
| 1,674,442 | 6/1928 | McNulty | 122/444 X |
| 2,468,694 | 4/1949 | Torr | 122/158 |
| 2,964,025 | 12/1960 | Rossi | 122/421 |
| 3,147,742 | 9/1964 | May | 122/7 R |
| 4,421,065 | 12/1983 | Tillequin | 122/138 X |
| 4,449,485 | 5/1984 | Tan | 122/214 X |
| 4,572,110 | 2/1986 | Haeflich | 122/1 R X |

*Primary Examiner*—Albert J. Makay
*Assistant Examiner*—Steven E. Warner
*Attorney, Agent, or Firm*—Brady, O'Boyle & Gates

[57] ABSTRACT

A furnace having a fire box at one end of a multi-unit cell boiler receives combustible refuse and delivers hot combustion gases through passages between water cells of the multi-unit cell boiler. The combustion gases enter an exhaust stack at the far end of the boiler after giving up most of their contained heat to the water circulating through the cells. Simultaneously, water flows through the base of the boiler on a circuitous path from its end adjacent to the exhaust stack toward the furnace and through cooling walls of the furnace and then through a holding tank to a pump which delivers the water to a header communicating with the cells of the boiler unit most distant from the furnace. The water being pumped into the cells is preheated to boost the thermal efficiency of the boiler. Steam generated in the boiler enters a steam header connected with the cell boiler unit nearest the furnace.

8 Claims, 9 Drawing Figures

FIG. 8
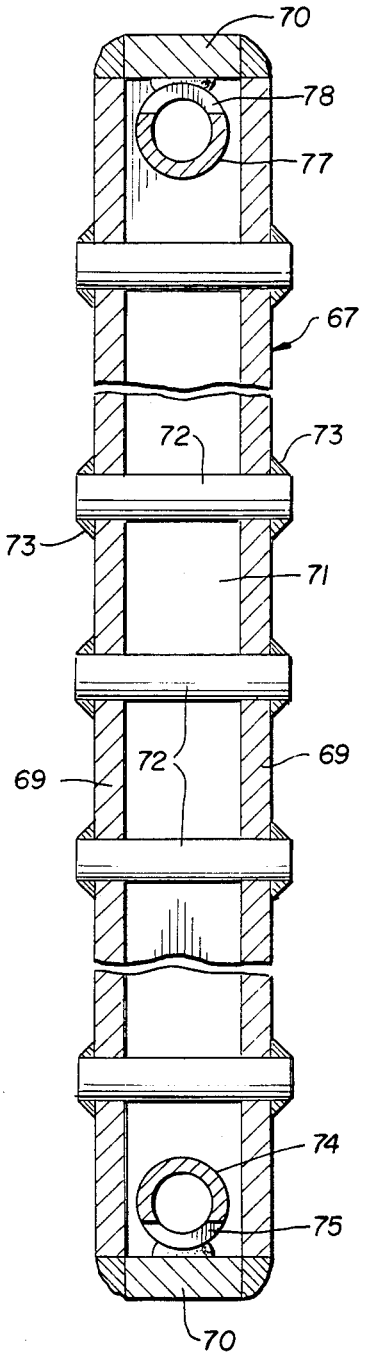
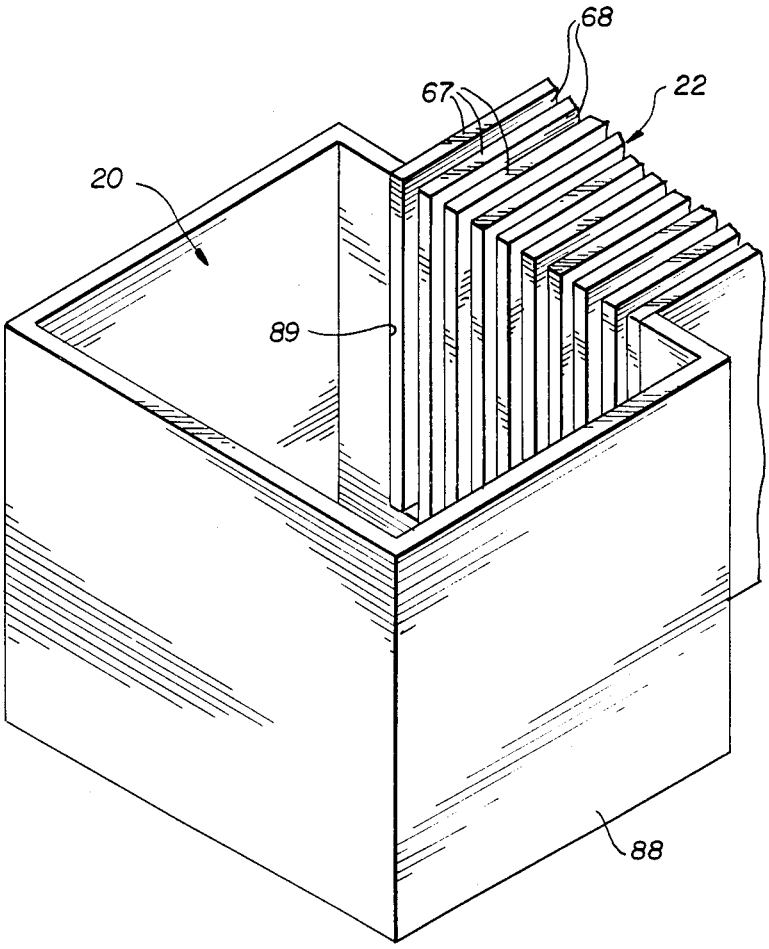
FIG. 9

CELL BOILER

BACKGROUND OF THE INVENTION

The present invention relates to a cell boiler suitable for converting thermal energy contained in garbage or other combustible materials into steam which can be utilized for generating electricity.

An object of the invention is to provide a cell boiler of comparatively low cost construction which may include a practical number of boiler units located between a furnace at one end of the boiler and a combustion products exhaust stack at the other end of the boiler.

A further object of the invention is to provide a cell boiler of the above character in which preheated water is circulated on a circuitous path through the several boiler units toward the furnace end of the boiler in heat transfer relationship with hot combustion gases flowing from the fire box of the furnace through a multitude of narrow passages between the multiple cells of the several boiler units, the hot gases flowing toward the exhaust stack at the far end of the boiler and, in so doing, giving up most of the contained heat energy to the water flowing in the cells of the boiler.

Another object of the invention is to provide a boiler which contains an extremely large total heat transfer surface area defined by the walls of the many narrow water cells of the several boiler units, which walls are washed by the hot combustion gases flowing from the furnace fire box to the exhaust stack at the far end of the boiler.

Still another object of the invention is to provide a boiler of the character described in which preheating water is caused to flow on a circuitous path through the base of the boiler from its end adjacent to the exhaust stack toward the furnace and through hollow cooling walls of the furnace and then through a holding tank to a pump which delivers the preheating water to a header of the boiler unit most distant from the furnace in which the preheated water begins its passage on the circuitous path through the multitude of cells in the several boiler units while flowing toward the furnace.

Other objects and advantages of the invention will become apparent to those skilled in the art during the course of the following detailed description.

BRIEF DESCRIPTION OF THE DRAWINGS

FIG. 8 is a transverse vertical section taken on line 8—8 of FIG. 6.

FIG. 9 is a fragmentary perspective view showing the furnace fire box and associated elements.

DETAILED DESCRIPTION

Figure 1:
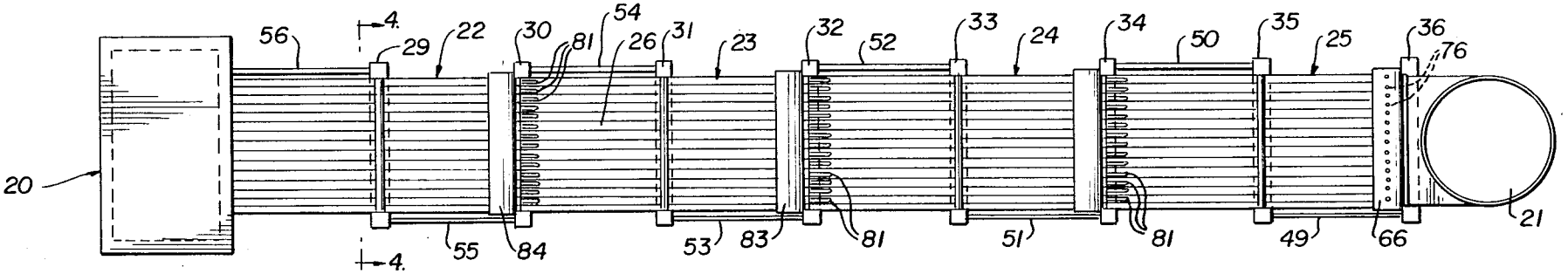
FIG. 1 is a plan view of a multi-unit cell boiler according to the present invention with the top wall of one boiler unit removed to show the cells of such unit.
Figure 2:
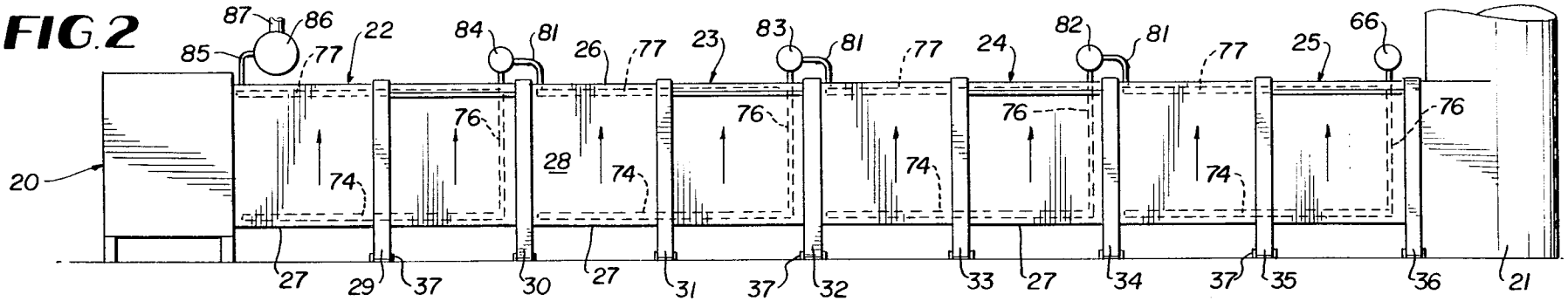
FIG. 2 is a side elevation of the multi-unit cell boiler.

Referring to the drawings in detail wherein like numerals designate like parts, a horizontally elongated multi-unit cell boiler shown in FIGS. 1 and 2 of the drawings includes a furnace 20 at one end thereof, a combustion products exhaust stack 21 at the other end thereof, and a practical number of cell boiler units 22, 23, 24 and 25 between the furnace 20 and the exhaust stack 21. While four cell boiler units are illustrated in the drawings, it should be understood that the invention is not limited to any particular number of cell units, and the number of cell units may vary depending upon circumstances.

Figure 4:
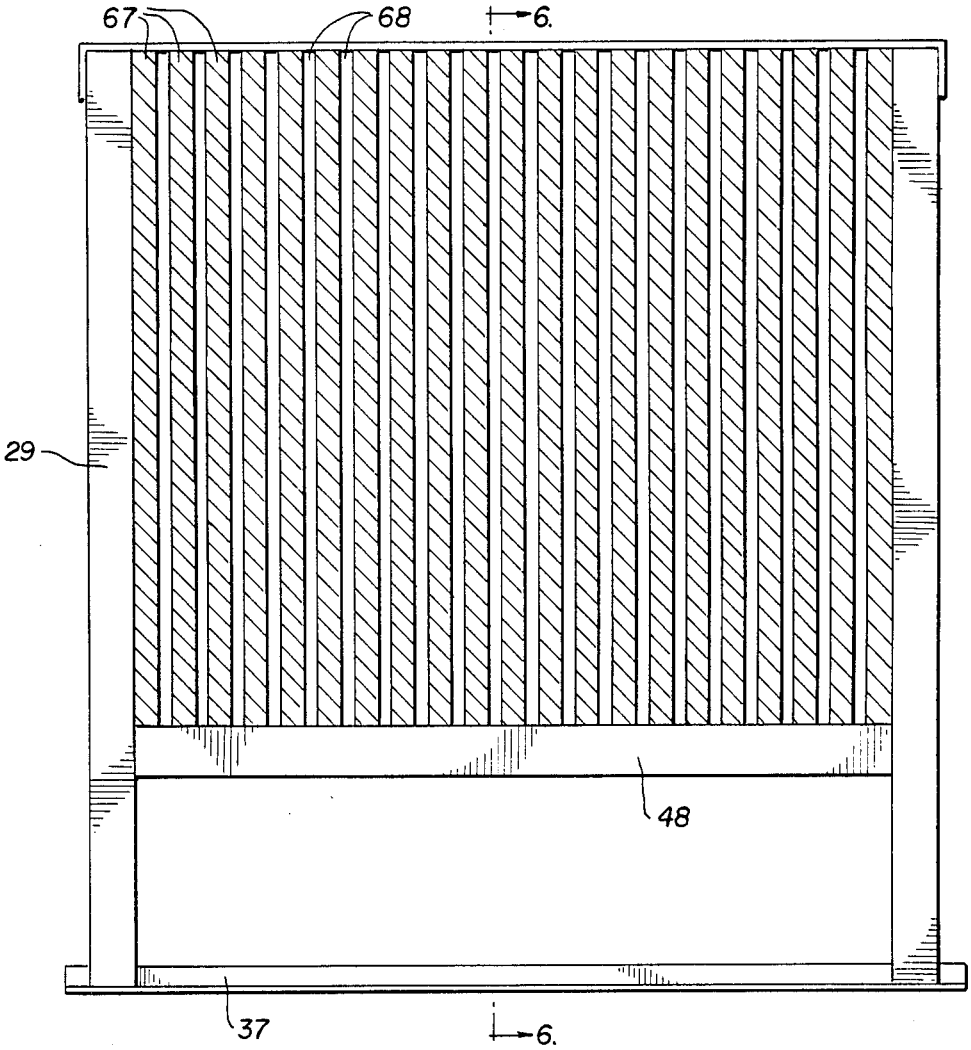
FIG. 4 is an enlarged transverse vertical section taken on line 4—4 of FIG. 1.

Each of the cell boiler units 22 . . . 25 includes a top wall 26, a bottom wall 27 and two side walls 28. The walls of the several boiler units are suitably connected end-to-end to form a continuous passageway for hot combustion gases flowing from the furnace 20 through the several boiler units 22 . . . 25 to the exhaust stack 21. The several boiler units are supported on vertical support frames 29, 30, 31, 32, 33, 34, 35 and 36 located at the centers and the registering ends of the units 22 . . . 25. The bottoms of the several support frames 29 . . . 36 rest on channel members 37, FIG. 4, which form elements of a boiler foundation structure, not shown.

Figure 3:
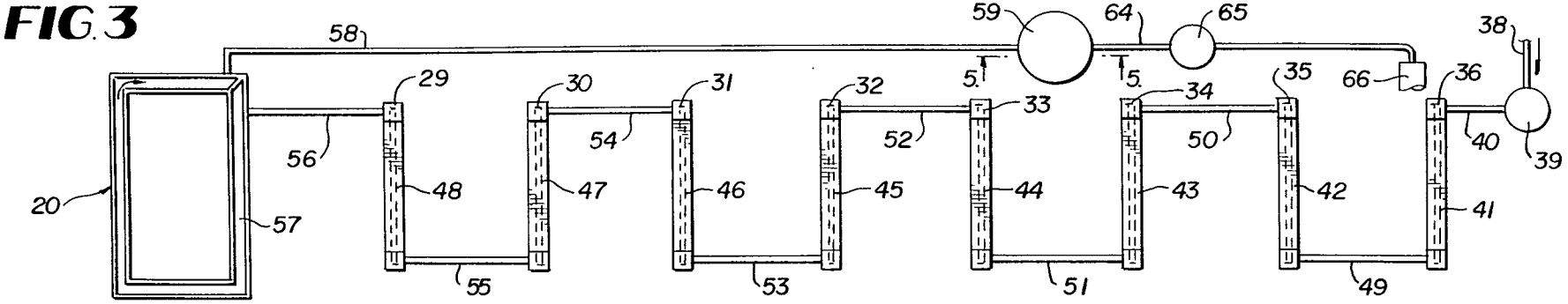
FIG. 3 is a diagrammatic plan view of the preheating water circulation system in the base of the boiler.

Water from a suitable source is delivered through a water supply line 38, FIG. 3, to a low pressure pump 39 having an outlet line 40 adjacent to the base of the boiler. Water from the line 40 enters and flows through a first horizontal transverse passage 41 at the base of the boiler unit 25. From this passage 41, the water flows on a circuitous or zigzag path horizontally at the base of the boiler through additional parallel transverse passages 42, 43, 44, 45, 46, 47 and 48 and through a corresponding number of longitudinal offset lines 49, 50, 51, 52, 53, 54, 55 and 56. All of these serially connected water passages and lines are adjacent to the bottom walls 27 of the cell boiler units 22 . . . 25.

Figure 5:
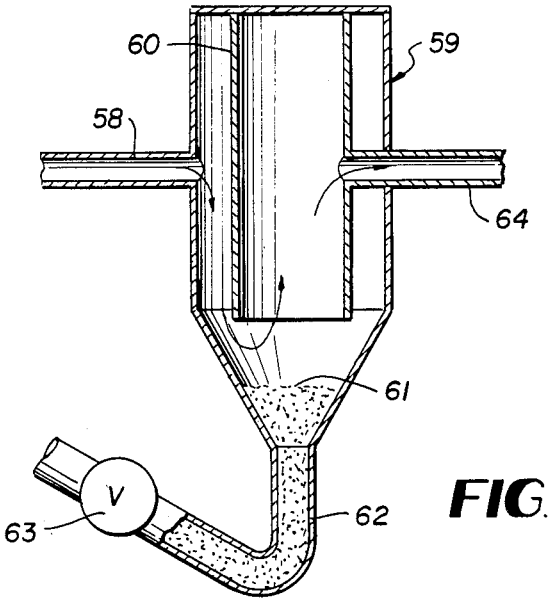
FIG. 5 is an enlarged fragmentary vertical section through a holding tank taken on line 5—5 of FIG. 3.

The longitudinal line 56 is connected into the furnace 20 which has hollow side walls forming a furnace water cooling passage 57 through which the water flows and enters a longitudinal return line 58 leading to a holding tank 59 shown in detail in FIG. 5.

The holding tank 59 includes an internal baffle sleeve 60 open at its lower end and a sediment chamber 61 for mud or the like beneath the sleeve 60, having a bottom outlet line 62 equipped with a sediment dump valve 63.

Water from the return line 58 enters the holding tank 59 as shown in FIG. 5 and passes upwardly into the baffle sleeve 60, from which the water discharges through another line 64 leading to a high pressure water pump 65, FIG. 3, which delivers preheated water to a first crossover header 66 near and above the end of the boiler unit 25 nearest the stack 21, FIG. 2.

Within each boiler unit 22 . . . 25 is a plurality of closely laterally spaced narrow vertical water cells 67 intervened by narrow vertical combustion gas passages 68. The gas passages 68 of the several boiler units 22 . . . 25 are all in longitudinal communication enabling hot gases from the fire box of furnace 20 to flow longitudinally through the entire boiler and enter the exhaust stack 21 after giving up substantially all of their contained heat to the water circulating through the cells 67 of the several boiler units.

As shown in FIG. 8, each cell 67 is a narrow closed hollow cell having parallel side walls 69, top and bottom walls 70 and end walls 71, the walls 70 and 71 being welded to the side walls 69. A multiplicity of closely spaced connecting rods 72 rigidly interconnect the side walls 69 and have their ends welded as at 73 to the exterior faces of the side walls 69.

Each cell 67 at its bottom includes an internal longitudinal pipe 74 welded at spaced intervals to the bottom wall 70 and having a series of water outlet slots 75 formed therein along the lower side of the pipe 74. A descending vertical pipe section 76, one for each cell 67, leads from the bottom of the header 66 through the top wall of the boiler unit 25 to the bottom of the cell 67 where it is joined to the horizontal pipe 74 of that particular cell.

Typically, there may be twenty-one cells 67 in each of the boiler units 22 . . . 25 and therefore twenty-one of the descending pipes 76 coming from the header 66, although the number of cells and pipes may vary depending on circumstances.

Figure 6:
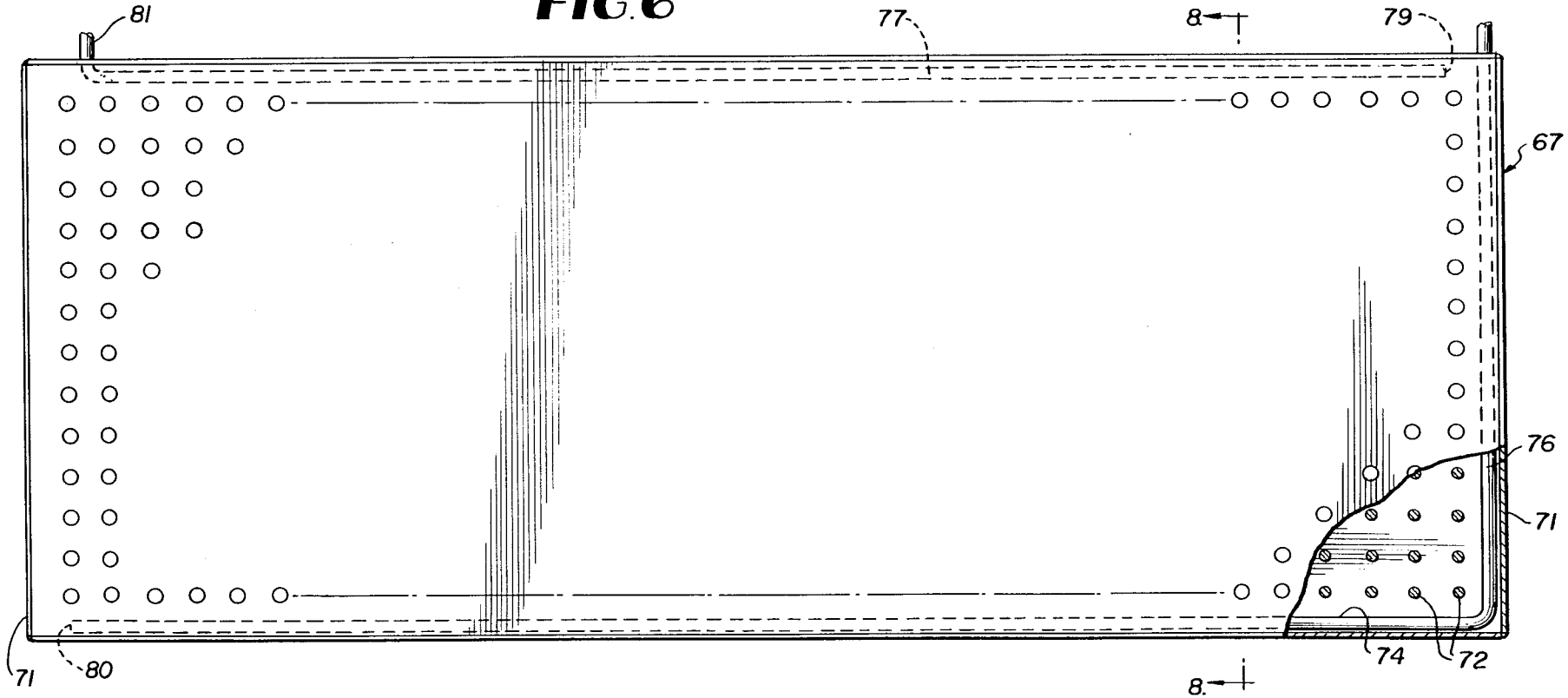
FIG. 6 is a longitudinal vertical section taken on line 6—6 of FIG. 4 showing one cell of one boiler unit with a portion of the cell side wall broken away.
Figure 7:
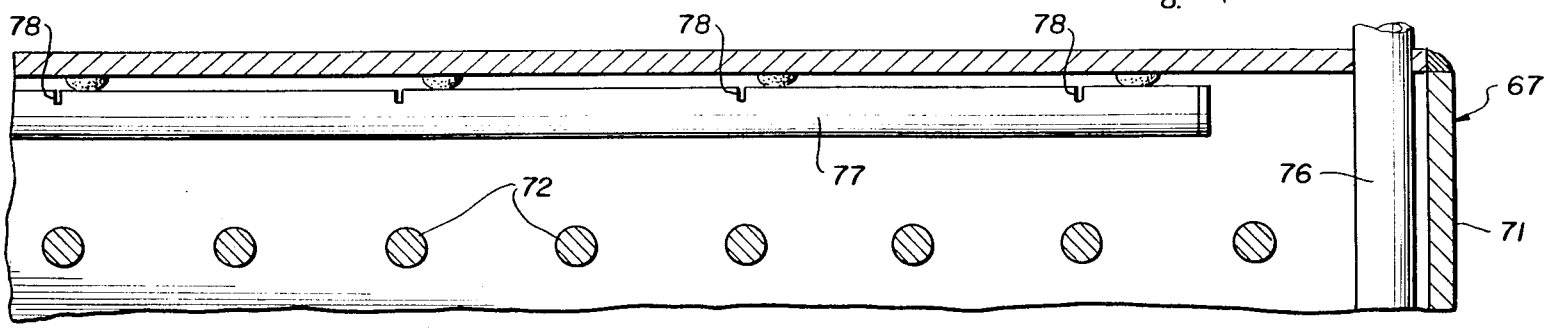
FIG. 7 is an enlarged fragmentary vertical section taken through the upper portion of the cell in FIG. 6.

In the top of each cell 67, a horizontal longitudinal pipe 77 is welded at spaced intervals to the top wall 70 and is provided along its length with a plurality of spaced inlet slots 78 for water. The top and bottom pipes 77 and 74 are plugged at their respective ends 79 and 80, FIG. 6, near the end walls 71 of each cell. The upper slotted pipe 77 has a rising elbow 81 connected therewith, there being one such elbow for each cell 67. As shown in FIG. 2, all of the elbows 81 are connected in a second crossover header 82 adjacent to one end of the next boiler unit 24. The arrangement is repeated for the boiler units 24, 23 and 22, each of which contains the same number of internal cells 67, lower and upper slotted pipes 74 and 77, descending pipes 76, and elbows 81, as described in connection with the boiler unit 25. The system includes additional crossover headers 83 and 84 for the boiler units 23 and 22, FIG. 2.

The described arrangement allows preheated water from the high pressure pump 65 to circulate serially through the multitude of cells 67 in the several boiler units 25, 24, 23 and 22. In doing this, the water from the first header 66 descends through the pipes 76 and enters the lower slotted pipes 74 of the vertical cells 67. The water discharges from the slots 75 of the lower pipes 74 and rises through the interior of the cell 67 where the water enters the upper pipe 77 through the inlet slots 78. All of the cells in each boiler unit operate in this manner simultaneously in parallel relationship. From the upper pipes 77 of the first unit 25, the water exits through the elbows 81 and enters the header 82 and from there passes downwardly through the pipes 76 to the bottom slotted pipes 74 of the cells 67 in the boiler unit 24. After rising through the cells in the boiler unit 24, the water again exits the upper pipes 77 and traverses the elbows 81 to the header 83. The same flow process continues until the high pressure water has traversed all of the cells of the several boiler units serially. In so doing, water and steam finally enter the cells 67 of the boiler unit 22 nearest the furnace 20 and, after rising therein, as shown by the directional arrows in FIG. 2, steam exits the pipes 77 through elbows 85 leading to and connected with a steam header 86 having risers 87 leading to points of steam consumption.

To enable this operation, the water level in the cells 67 of the boiler unit 22 is held 6"–8" below the upper exit pipes 77 thereby allowing steam only to pass through the elbows 85 to the steam header 86.

Thus, in a simplified continuous operation, low pressure water from the low pressure pump 39 is passing through the circuitous water preheating system at the base or floor of the boiler shown in FIG. 3. Further preheating occurs as this water traverses the hollow walls of the furnace 20. The preheated sediment-free water in the holding tank 59 is then delivered by the high pressure pump 65 to the first crossover header 66, as described above, and the preheated water then begins its passage through the cells 67 of the boiler units 25, 24, 23 and 22 serially, as described in detail. The primary exchange of heat occurs between the hot furnace exhaust gases passing through the multitude of narrow spaces 68 between the cells 67 as the hot gases move toward the stack 21 substantially in counterflow heat transfer relationship to the high pressure water rising through the cells 67 of the several boiler units serially. By this process, some steam is generated in each boiler unit and greater amounts of steam are generated in the boiler units nearest the furnace 20 where the gases are the hottest. When the gases reach the exhaust stack 21, they are relatively cool since most of the contained thermal energy has been transferred to the water in the cells 67.

FIG. 9 depicts the furnace fire box 88 having a deep opening 89 in one side wall thereof which is in direct communication with the narrow gas passages 68 between the cells 67 of the boiler unit 22 adjacent to the furnace 20. Other details of the fire box and furnace are unimportant to a proper understanding of the invention.

The pressure of the water as it reaches the high pressure pump 65 is virtually zero pressure. This is at the end of the water preheating cycle. The high pressure pump may pressurize the water in the primary heat transfer part of the system defined by the cells 67 and associated elements up to as much as 2000 psi.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A cell boiler comprising a furnace, plural connected cell boiler units extending away from one side wall of the furnace, each cell boiler unit including therein a multiplicity of narrow cells and intervening narrow gas flow passages extending substantially from top-to-bottom of said units, the gas flow passages of said units being in communication lengthwise of said units to define a continuous gas flow passage away from the furnace and communicating with a fire box of the furnace, a water preheating means substantially on the bottom of the boiler including a circuitous conduit for water spanning the bottoms of said units of the boiler, a preheated water conduit connected in and extending away from the furnace cooling means, a preheated water holding tank having a sediment chamber connected in the preheated water conduit, a high pressure pump for preheated water connected in the preheated water conduit between said holding tank and inlet means connected with the interiors of said cells of the boiler units, means to deliver water at a comparatively low pressure through said preheating means, and means to deliver the preheated water at a comparatively high pressure through the interiors of said cells of the boiler units serially while simultaneously hot gases from the fire box of said furnace are traversing the continuous gas passage through said units defined by the narrow spaces between said cells generally in counterflow heat transfer relationship to the water being delivered through the cells of said units serially, and a steam collecting means communicating with the cells of at least the cell boiler unit nearest said furnace.

2. A cell boiler as defined in claim 1, and the inlet means including a preheated water header adjacent to the boiler unit most distant from the furnace and having outlet conduits connected with and delivering preheated water to the interiors of said cells of the last-named boiler unit.

3. A cell boiler comprising a furnace, plural connected cell boiler units extending away from one side wall of the furnace, each cell boiler unit including therein a multiplicity of narrow cells and intervening narrow gas flow passages extending substantially from top-to-bottom of said units, the gas flow passages of said units being in communication lengthwise of said units to define a continuous gas flow passage away from the furnace and communicating with a fire box of the furnace, a water preheating means substantially on the bottom of the boiler including a circuitous conduit for water spanning the bottoms of said units of the boiler, means to deliver water at a comparatively low pressure through said preheating means, and means to deliver the preheated water at a comparatively high pressure through the interiors of said cells of the boiler units serially while simultaneously hot gases from the fire box of said furnace are traversing the continuous gas passage through said units defined by the narrow spaces between said cells generally in counterflow heat transfer relationship to the water being delivered through the cells of said units serially, said cells each containing near their bottoms a slotted water inlet pipe connected to said means to deliver preheated water at comparatively high pressure through the interiors of the cells and each including near their tops a slotted water discharge pipe, additional conduit means connected with each discharge pipe of each cell for delivering water and steam from each cell of each boiler unit to the cells of a next adjacent boiler unit nearer said furnace, and a steam collecting means communicating with the cells of at least the cell boiler unit nearest said furnace.

4. A cell boiler as defined in claim 3, and said furnace having a fire box provided in one side wall thereof with an opening in direct communication with said continuous gas flow passage defined by said intervening narrow gas flow passages.

5. A cell boiler comprising a furnace, plural connected cell boiler units extending away from one side wall of the furnace, each cell boiler unit including therein a multiplicity of narrow cells and intervening narrow gas flow passages extending substantially from top-to-bottom of said units, the gas flow passages of said uits being in communication lengthwise of said units to define a continuous gas flow passage away from the furnace and communicating with a fire box of the furnace, a water preheating means substantially on the bottom of the boiler including a circuitous conduit for water spanning the bottoms of said units of the boiler, means to deliver water at a comparatively low pressure through said preheating means, and means to deliver the preheated water at a comparatively high pressure through the interiors of said cells of the boiler units serially while simultaneously hot gases from the fire box of said furnace are traversing the continuous gas passage through said units defined by the narrow spaces between said cells generally in counterflow heat transfer relationship to the water being delivered through the cells of said units serially, each narrow cell being hollow and having side walls defining a water and steam chamber in the cell, slotted water inlet and water outlet pipes fixed in each cell adjacent to the bottom and top thereof and being bodily disposed in said water and steam chamber with the slots thereof in communication with the chamber, connector elements secured to the side walls of each cell and extending across the water and steam chamber thereof, and a steam collecting means communicating with the cells of at least the cell boiler unit nearest said furnace.

6. A cell boiler comprising a furnace, serially connected cell boiler units extending away from one side wall of the furnace, the cell boiler unit nearest the furnace being connected with said one side wall and being in communication with a fire box of the furnace, each cell boiler unit having external wall means and containing therein a multiplicity of narrow vertical closely spaced hollow water and steam cells intervened by a multiplicity of narrow gas flow passages, said gas flow passages of the cell boiler units collectively forming a continuous gas flow passage means away from the furnace fire box and receiving hot combustion gases therefrom, the cells of said cell boiler units each having apertured water inlet and outlet pipes fixed therein adjacent to the bottoms and tops of the cells, headers individual to the cell boiler units for delivering high pressure water to the apertured water inlet pipes of the cells serially with respect to the cell boiler units, and conduit means for delivering water from the apertured outlet pipes of the cells to said headers serially with respect to the cell boiler units.

7. A cell boiler as defined in claim 6, and each header being common to the cells of one cell boiler unit and extending transversely across the top of one cell boiler unit, and a multiplicity of descending water delivery pipes connected with each header and corresponding in number to the cells of the unit and leading to and being connected with the apertured water inlet pipes adjacent to the bottoms of the cells of the cell boiler unit.

8. A cell boiler as defined in claim 7, and a further multiplicity of pipes connected to said outlet pipes at the tops of the cells and leading to and being connected with the header of the next adjacent cell boiler unit.

* * * * *